United States Patent [19]

Von Hoene et al.

[11] 4,063,945

[45] Dec. 20, 1977

[54] ELECTROSTATOGRAPHIC IMAGING METHOD

[75] Inventors: Donald C. Von Hoene, Fairport; Richard L. Post, Penfield, both of N.Y.

[73] Assignee: Xerox Corporation, Stamford, Conn.

[21] Appl. No.: 769,492

[22] Filed: Feb. 17, 1977

[51] Int. Cl.[2] ..... G03G 13/22; G03G 13/24

[52] U.S. Cl. ..... 96/1 R; 96/1 C

[58] Field of Search ..... 96/1 R, 1 C

[56] References Cited

U.S. PATENT DOCUMENTS

| | | | |
|---|---|---|---|
| 3,615,395 | 10/1971 | Yamaji et al. | 96/1 R X |
| 3,666,363 | 5/1972 | Tanaka et al. | 96/1 C |
| 3,666,364 | 5/1972 | Marushima | 96/1 R X |
| 3,775,104 | 11/1973 | Matsumoto et al. | 96/1 C X |
| 3,797,928 | 3/1974 | Kinoshita et al. | 96/1 R X |
| 3,873,310 | 3/1975 | Bean | 96/1 C X |

*Primary Examiner*—Roland E. Martin, Jr.
*Attorney, Agent, or Firm*—James J. Ralabate; James P. O'Sullivan; Jerome L. Jeffers

[57] ABSTRACT

Disclosed is a method for forming a latent electrostatic image on a photosensitive device comprising a grounded conductive substrate having on its surface a layer of photoconductive material which is in turn overcoated with a layer of insulating organic resin. The method involves applying an initial electrostatic charge of one polarity to the surface of the photosensitive device followed by the steps of:

1. applying to the surface of the photosensitive device an electronic field of direct current having a polarity opposite to that of the initial electrostatic charge, and, either simultaneously or sequentially, exposing the device to imagewise activating radiation;
2. uniformly exposing the device to activating radiation; and
3. applying an electrostatic charge of the same polarity as that of the initial charge to the surface of the photosensitive device to thereby simultaneously erase the electrostatic charge from the device and initially charge it as the first step in the next cycle.

10 Claims, 9 Drawing Figures

ELECTROSTATOGRAPHIC IMAGING METHOD

BACKGROUND OF THE INVENTION

This invention relates to electrostatographic copying and more particularly to a novel method for imaging a particular type of electrostatographic photoreceptor. The art of xerography, as originally disclosed in U.S. Pat. No. 2,297,691 by C. F. Carlson, involves the formation of an electrostatic latent image on the surface of a photosensitive plate normally referred to as a photoreceptor. The photoreceptor comprises a conductive substrate having on its surface a layer of a photoconductive insulating material. Normally, there is a thin barrier layer between the substrate and the photoconductive layer to prevent charge injection of the minority carrier from the substrate into the photoconductive layer upon charging of the plate's surface.

In operation, the plate is charged in the dark, such as by exposing it to a cloud of corona ions, and imaged by exposing it to a light and shadow image to selectively discharge the photoreceptor and leave a latent image corresponding to the shadow areas. The latent electrostatic image is developed by contacting the photoreceptor's surface with an electroscopic marking material known as toner which will adhere to the latent image due to electrostatic attraction. Transfer of the toner image to a receiving member such as paper with subsequent fusing of the toner into the paper provides a permanent copy.

One type of electrostatographic photoreceptor comprises a conductive substrate having a layer of photoconductive material on its surface which is overcoated with a layer of an insulating organic resin. Various methods of imaging this type of photoreceptor are disclosed by Mark in his article appearing in *Photographic Science and Engineering,* Vol. 18, No. 3, May/June 1974. The processes disclosed in this article all employ a separate presensitization step which involves exposing the photosensitive device to d.c. corona of a polarity opposite to that of the majority charge carrier. When applying a positive charge to the surface of the insulating layer as in the case where an n-type photoconductor is employed, a negative charge is induced in the conductive substrate, injected into the photoconductor and transported to and trapped at the insulating layer-photoconductive layer interface resulting in an initial potential being solely across the insulating layer. The charged plate is then exposed to a light and shadow pattern either during or after the application of a secondary electrostatic charge which may be either a.c. current or d.c. current of polarity opposite to that of the initial charge. Flooding uniformly with light reduces the potential in the photoconductive layer to zero volts and results in the formation of a latent image on the surface of the device which is developed in the normal xerographic mode by the application toner thereto. After transfer of the toner to a transfer member, the latent image is erased by the simultaneous application of light and a d.c. or a.c. corona device and the device is prepared for the next cycle by again presensitizing it.

The present invention condenses the erasure and presensitization steps into a unitary operation thereby reducing the usual four step process (initial charge, shuntexpose, flood, erase) to a three step process.

SUMMARY OF THE INVENTION

The present invention is a method of forming a latent electrostatic image on a photosensitive device comprising a grounded conductive substrate having on its surface a layer of photoconductive material with a layer of an insulating organic resin overlaying the layer of photoconductive material. The method comprises applying an initial electrostatic charge of one polarity to the surface of the photosensitive device to provide an initial potential which is solely across the insulating layer followed by the steps of:

1. applying to the surface of the photosensitive device an electronic field of direct current having a polarity opposite to that of the initial electrostatic charge to drive the initial potential to a potential included in the range extending from a potential less than the initial potential through zero to a chosen potential opposite in sign to the polarity of the initial potential and, either simultaneously or sequentially, exposing the photosensitive device to imagewise activating radiation thereby forming an imagewise potential distribution across the layer of photoconductive material;

2. forming an imagewise potential distribution across the insulating layer by uniformly exposing the device to activating radiation; and 3. applying an electrostatic charge of the same polarity as that of the initial charge to the surface of the photosensitive device to thereby simultaneously erase the electrostatic charge from the device and initially charge it as the first step in the next cycle.

Whether the application of the electronic field and imagewise activating radiation in step 1 is simultaneous or sequential will depend on the carrier lifetimes of the particular photoconductor used.

In order to place an initial potential solely across the insulating layer it is necessary that the photosensitive device be designed so as to either have an injecting interface between the substrate and the photoconductive layer which allows the injection of the majority carrier into the photoconductive layer, an ambipolar photoconductive layer which can be discharged with highly absorbed light when charged to either polarity or a layer which allows for uniform absorption in the bulk so that complete discharge can be achieved for either charging polarity as needed.

During the third step it is necessary to maintain the potential in the photoconductive layer near zero volts by employing uniform light discharge or an appropriate injecting interface layer to inject the majority charge carriers.

DETAILED DESCRIPTION AND PREFERRED EMBODIMENTS

Figure 1:
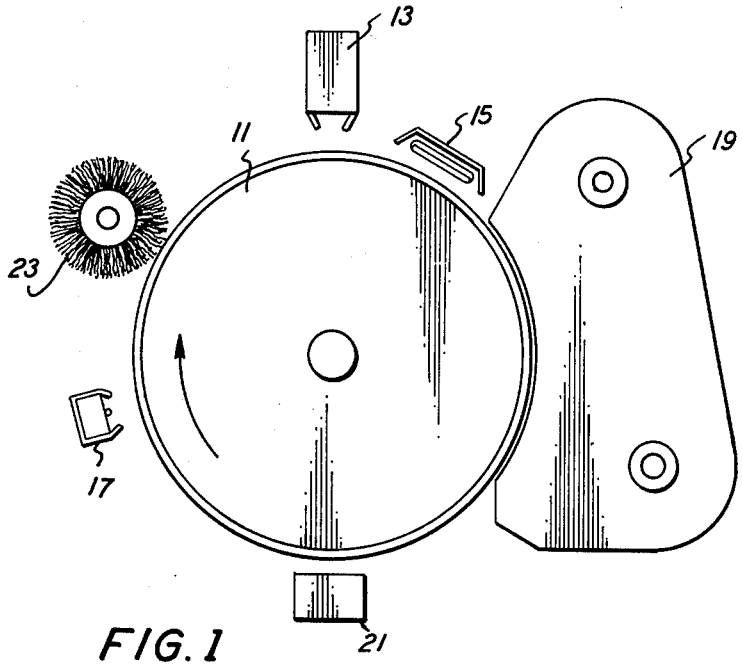
FIG. 1 is a schematic representation of the apparatus used in the present invention.

The method of practicing the present invention is more fully illustrated by FIG. 1 which represents a cross-sectional view of the apparatus contemplated for use in the present invention. The photosensitive device is represented as being in a drum type configuration designated in the drawing as 11. During the first cycle of the machine operation, where no copy is made, the surface of the photosensitive device is sensitized by applying an initial electrostatic charge of one polarity to its surface. This is normally accomplished at erasure corotron 17. The initial charging, which is accomplished by use of a d.c. corotron, provides an initial potential which is solely across the insulating layer. After initial charging, the drum, which is rotated in a clockwise direction, passes under the combination exposure lamp and corotron designated as 13 in FIG. 1. At this point the presensitized photosensitive device is exposed to an electronic field of polarity opposite to that of the initial charge while being irradiated in imagewise configuration with activating radiation. The cooperative effect of the secondary charging and illumination results in an imagewise potential distribution being formed across the insulator and photoconductive layers. The exposed surface of the device is at a uniform potential. At this point, the electrostatic fields are internal and therefore not developable. The next step, i.e. uniformly exposing the photosensitive device to activating radiation, is accomplished via fluorescent lamp 15. In this step of the process the imagewise potential distribution formed across the photosensitive layer is erased resulting in the imagewise potential distribution at the exposed insulator surface being available to be developed in the conventional manner. Development is accomplished at development station 19 and the toner image transferred to a receiving member at transfer station 21.

At this point the photosensitive device is erased by applying an electrostatic charge of the same polarity as that of the initial charge to its surface to thereby simultaneously erase the remaining electrostatic charge and to initially charge it as the first step of the next cycle. This step is accomplished at erasure station 17. Here again, an injecting interface layer for majority carriers or light is required to maintain the potential across the photoconducting layer near zero volts. Excess toner is removed at cleaning station 23 and the cleaned portion of the drum returns to corotron/light 13 already presensitized for the next cycle.

Figure 2A:
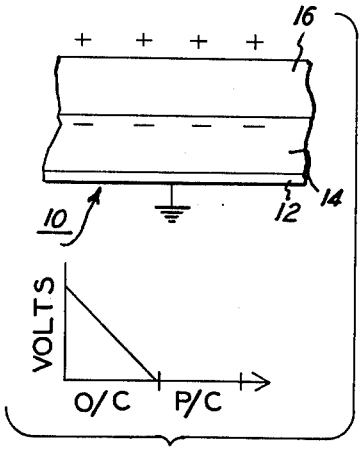
FIGS. 2–4 illustrate the electronic fields generated in the photosensitive device during the various steps of the process.
Figure 2B:
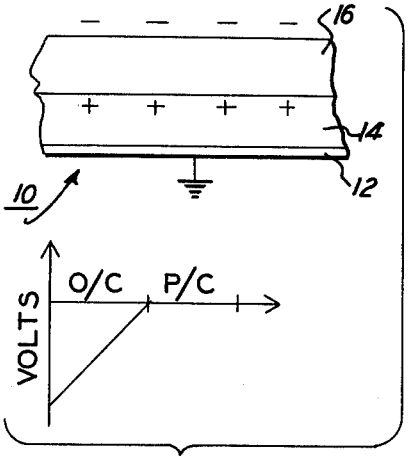

The mechanism by which the latent image is formed is more fully illustrated by FIGS. 2*a* and 2*b*. In this figure a photosensitive device of the type useful in the present invention, generally depicted as 10, has a grounded, conductive substrate 12 with a layer of photoconductive material on its surface 14 which is in turn overcoated with a layer of insulating organic resin 16. Typically, there will be a thin injecting interface layer between the substrate and photoconductive layer. In the erasure/charging step of the process under consideration the initial potential to be placed across the overcoating is taken to be positive (+) corresponding to the majority carriers being electrons in the photosensitive layer. Shown in FIG. 2*a* and 2*b* are image potentials to be erased which could be either plus (2*a*) or minus (2*b*). Also shown are the potential distributions through the device. In both cases the initial positive charging potential is achieved by effectively further charging the device with positive charge. In the case of FIG. 2*a* additional positive charging initially adds more field to the photoconductive layer as depicted by FIG. 3.

By suitable injection of the majority carriers at the substrate, for example, the appropriate initial potential is achieved across the overcoating.

Figure 4A:
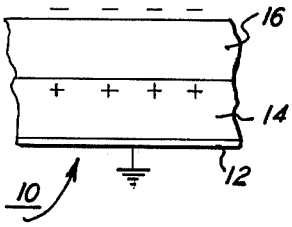
Figure 4B:
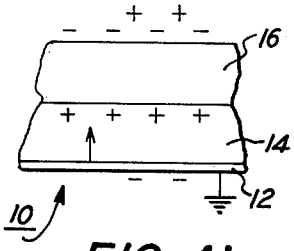
Figure 4C:
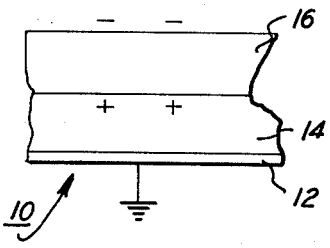

In the case of FIG. 2*b* where a negative potential is left initially, the corona spray of positive charge neutralizes the surface negative charge and again creates field in the photoconductive layer which must be removed, for example, by injection of the majority carriers as shown in FIGS. 4*a, b* and *c* at an intermediate time where the initial negative potential has been reduced by half.

Figure 3:
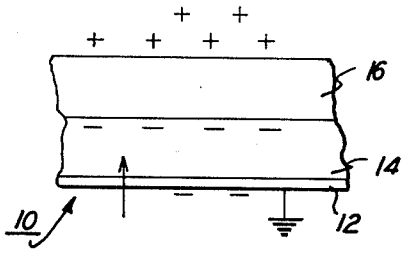

Once the potential is reduced to zero volts, the process continues as in FIG. 3 until the desired positive initial potential is achieved across the insulating layer.

The corona charging device required is one which operates as a constant voltage device and will charge all points of the photoreceptor surface to the same initial potential across the overcoating irrespective of the starting image potential whether it be positive or negative. Such a charging device may be a biased a.c. corotron with a plastic shield or a corona device which employs a glass coated wire and a biased shield.

The substrate upon which the layer of photoconductive material is deposited may be made up of any suitable conductive material. It may be rigid as in the case where a flat plate or drum configuration is employed or flexible as in the case of a photosensitive device in the form of an endless belt. In this embodiment, a continuous, flexible, nickel belt or a web or belt of an aluminized polymer such as Mylar may be used.

If the substrate is not naturally injecting, a suitable interface should be provided to cause injection of the majority carrier from the substrate to the layer of photoconductive material to cause the initial potential to reside solely across the insulating overcoating. In the case of an ambipolar photoconductor, a suitable interface should be provided to block injection of the carrier having the sign of the initial surface potential. As previously mentioned, a layer which allows for uniform absorption in the bulk such as a CdS binder layer may be employed.

The layer of photoconductive material may be either n-type or p-type, organic or inorganic and is selected from those materials recognized in the art of xerography as being useful as xerographic photoconductors. Exemplary of useful photoconductive materials are CdS, CdSe, $CdS_xSe_{1-x}$, ZnO, $TiO_2$ and selenium and selenium alloys such as Se/Te and Se/As. Typically, these materials are dispersed in an insulating resin as binder such as the configuration disclosed in U.S. Pat. No. 3,121,006 or the geometry controlled configuration disclosed in U.S. Pat. No. 3,787,208.

The insulating resin which constitutes the top layer of the photoreceptor can be any material which has high resistance against wear, high resistivity and the capability of binding electrostatic charge. In addition, the material should be transparent or translucent to activating radiation. Examples of resins which may be used are polystyrene, butadiene polymers and copolymers, acrylic and methacrylic polymers, vinyl resins, alkyd resins, polycarbonate resins and polyester resins.

The method by which the imaging method of the present invention is carried out is further illustrated by the following examples.

EXAMPLE I

A photosensitive device of the type contemplated for use in the present invention is fabricated with a binder layer type photoconductive layer. The binder layer is prepared using a polyester resin as the matrix material with 30 volume percent $CdS_{0.35}Se_{0.65}$ uniformly dispersed therein to provide a 40 μm thick photoconductive layer. The layer is cast on an aluminum drum to which has been applied a particulate graphite layer to serve as ground and provide a partially injecting contact. A 25 μm thick layer of Mylar polyester is applied over the photoconducting layer to serve as the insulating overcoating.

The so-formed photoreceptor is charged to $+V_o$, exposed to activating radiation in an imagewise manner while being shunted to near zero volts, flood illuminated and erased. A three wire D.C. corona charging device is used in combination with light to effectuate erase of the device. The process is carried out at a photoreceptor speed of 10 inches/sec. with the charging device RC time constant so as to behave as a constant voltage charging device bringing all points to the same potential of about +2,300 volts as part of the erase step.

Figure 5:
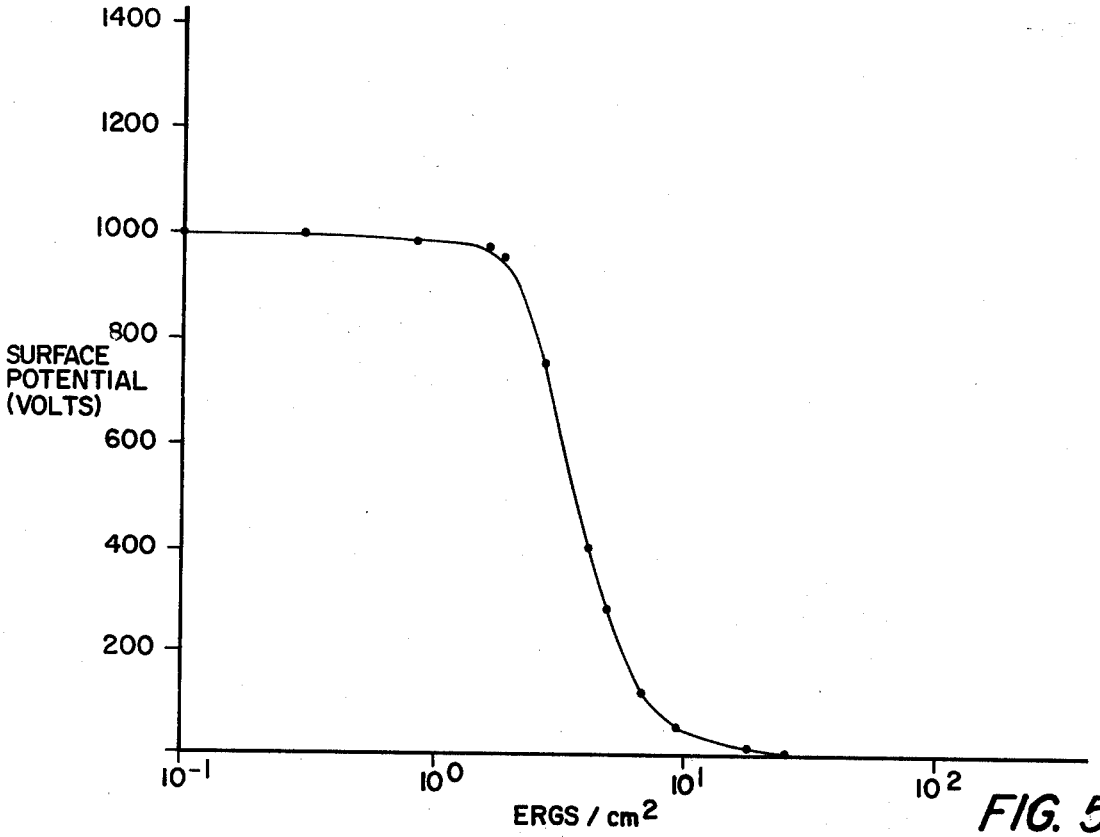
FIGS. 5–6 are discharge curves obtained from photosensitive devices which are charged and exposed according to the present invention.

At the imagewise expose-shunt step, the device is shunted to near zero volts, and a discharge curve, set out in FIG. 5, is prepared. The light source used in this step is a Xenon lamp equipped with 400 nm and 700 nm filters admitting wavelengths only between these two values.

Alternative charging devices include a glass coated wire device or a biased a.c. wire device.

EXAMPLE II

A photosensitive device is fabricated using a 30 volume percent CdS/polyester binder layer of 30 μm in thickness at the photoconducting layer. This layer is applied to an aluminum drum having a graphite layer on its surface to serve as ground and provide a partially injecting contact. A 25 μm layer of Mylar polyester is applied over the photoconducting layer.

Figure 6:
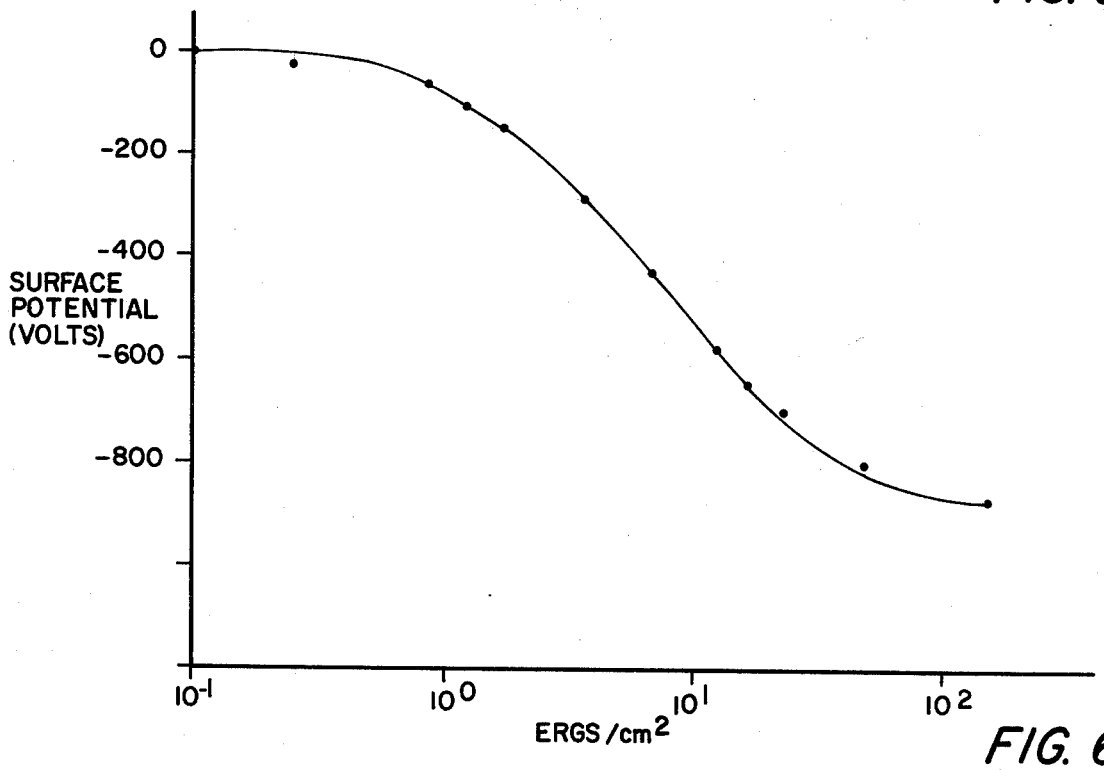

The device is initially charged to $(+V_o)$, imagewise exposed and shunted to a negative potential, flooded and erased with the erase and charge steps being incorporated into a single step. The charging device employed charges the device to a Vo of about +1500 volts with the device being shunted to −900 volts during the expose/shunt step. A discharge curve is obtained during this procedure and presented as FIG. 6.

What is claimed is:

1. A method of forming a latent electrostatic image on a photosensitive device comprising a grounded conductive substrate having on its surface a layer of photoconductive material which is in turn overcoated with a layer of electrically insulating organic resin which method comprises applying an initial electrostatic charge of one polarity to the surface of the photosensitive device to provide an initial potential which is solely across the insulating layer followed by the steps of:

a. applying to the surface of the photosensitive device an electronic field of direct current having a polarity opposite to that of the initial electrostatic charge to drive the initial potential to a potential included in the range extending from a potential less than the initial potential through zero to a chosen potential opposite in sign to the polarity of the initial potential and, either simultaneously or sequentially, exposing the photosensitive device to imagewise activating radiation thereby forming a imagewise potential distribution across the layer of photoconductive material;

b. forming an imagewise potential distribution across the insulating layer by uniformly exposing the device to activating radiation; and c. applying an electrostatic charge of the same polarity as that of the initial charge to the surface of the photosensitive device to thereby simultaneously erase the electrostatic charge from the device and initially charge it as the first step in the next cycle.

2. The method of claim 1 wherein after the completion of step (c) in the initial cycle, additional cycles consisting of steps (a), (b) and (c) are carried out.

3. The method of claim 1 wherein the photoconductive material is CdS, CdSe, $CdS_xSe_{1-x}$, ZnO, $TiO_2$, selenium or a selenium alloy.

4. The method of claim 3 wherein the selenium alloy is Se/Te or Se/As.

5. The method of claim 1 wherein the photoconductive material is dispersed in an insulating resin binder.

6. The method of claim 1 wherein the insulating resin is polystyrene, a butadiene polymer, an acrylic or methacrylic polymer, a vinyl resin, an alkyd resin, a polycarbonate resin or a polyester resin.

7. The method of claim 1 wherein the conductive substrate is aluminum, the photoconductive material is a binder layer of $CdS_{0.35}Se_{0.65}$ dispersed in a polyester and the insulating organic resin is Mylar polyester.

8. The method of claim 7 wherein the initial potential is positive and the secondary charging in step (a) drives the initial potential to near zero.

9. The method of claim 1 wherein the conductive substrate is aluminum having a graphite layer on its surface, the photoconductive material is CdS dispersed in a polyester and the insulating organic resin is Mylar polyester.

10. The method of claim 1 wherein the initial charge is positive and the secondary charging in step (a) drives the initial potential to a negative potential.

* * * * *